US008434625B2

(12) United States Patent
Angus

(10) Patent No.: US 8,434,625 B2
(45) Date of Patent: May 7, 2013

(54) CLIP RAILS FOR USE WITH SCREENING APPARATUS

(76) Inventor: Robert Bruce Angus, Dutton Park (AU)

( * ) Notice: Subject to any disclaimer, the term of this patent is extended or adjusted under 35 U.S.C. 154(b) by 0 days.

(21) Appl. No.: 12/812,147

(22) PCT Filed: Jan. 14, 2009

(86) PCT No.: PCT/AU2009/000033

§ 371 (c)(1),
(2), (4) Date: Jul. 8, 2010

(87) PCT Pub. No.: WO2009/089578

PCT Pub. Date: Jul. 23, 2009

(65) Prior Publication Data

US 2010/0282649 A1 Nov. 11, 2010

(30) Foreign Application Priority Data

Jan. 14, 2008 (CN) ..... 2008 2 0000473 U

(51) Int. Cl.
*B07B 1/49* (2006.01)

(52) U.S. Cl.
USPC ..... 209/405; 209/409

(58) Field of Classification Search ..... 209/399, 209/405, 409, 395
See application file for complete search history.

(56) References Cited

U.S. PATENT DOCUMENTS

| | | | | |
|---|---|---|---|---|
| 5,377,846 | A | 1/1995 | Askew | |
| 5,829,599 | A | 11/1998 | Woodgate | |
| 6,253,926 | B1 | 7/2001 | Woodgate | |
| 7,063,214 | B2 * | 6/2006 | Schulte et al. | 209/405 |
| 2002/0195377 | A1 | 12/2002 | Trench et al. | |
| 2004/0149632 | A1 * | 8/2004 | Schulte et al. | 209/405 |
| 2006/0175233 | A1 | 8/2006 | Zubovich et al. | |
| 2008/0078702 | A1 * | 4/2008 | Carr et al. | 209/326 |

FOREIGN PATENT DOCUMENTS

| | | |
|---|---|---|
| AU | 199520043 | 11/1995 |
| AU | 199716500 | 10/1997 |
| WO | 00/53343 | 9/2000 |

OTHER PUBLICATIONS

P. Ellis, International Search Report in PCT/AU2009/000033, Apr. 22, 2009, 4 pages, Australian Patent Office, Woden ACT, Australia.

* cited by examiner

*Primary Examiner* — Joseph C Rodriguez
*Assistant Examiner* — Kalyanavenkateshware Kumar
(74) *Attorney, Agent, or Firm* — Florek & Endres PLLC

(57) ABSTRACT

A clip rail comprises an elongated body having a first end and a second end. The elongated body defines an upper recess configured to engage with one or more screen panels, the elongated body further defines a lower recess configured to engage a support member of a screening apparatus. Each of the first end and second end includes a two-platform structure, the two-platform structure configured to engage with another two-platform structure, wherein the first platform is offset from the second platform. Further, the first platform is adjacent to the second platform, and the second platform is laterally and vertically offset from the first platform, and the first platform is in a first plane and the second platform is in a second plane. The elongated body may further define first and second opposed, upper sidewalls extending upwardly along the length of the elongate body, the first and second opposed, upper sidewalls defining the upper recess, and first and second opposed, lower sidewalls extending downwardly along the length of the body, the opposed lower sidewalls defining the lower recess.

15 Claims, 9 Drawing Sheets

CLIP RAILS FOR USE WITH SCREENING APPARATUS

TECHNICAL FIELD

The present invention relates to screening apparatus, and more particularly, clip rails used to secure screen panels to screening apparatus.

BACKGROUND OF THE UTILITY MODEL

Vibrating screen machines for use in the mineral processing industries are commonly used to separate minerals such as coal or ores by size, usually after crushing. The apparatus generally comprises RHS or boxed I-beam cross members spacing apart a pair of side walls. The cross members support a screen panel assembly of spaced apart screen support members for supporting the ends of modular screen inserts and intermediate stringer members mounting the screen support members to the cross members. The side walls are further interconnected by an upper box-section cross beam which serves as a mount for exciter units. The upper end of the assembly includes a feed box that doubles as a further cross member. The screen panel may be flat or may be curved to form a so-called banana screen.

Known intermediate members are subject to wear and failure during use of the screening apparatus. Clip rails are used to connect screen panels to the screen panel support members. These clip rails are subject to wear and potentially damage. This risk may be higher at end joins of adjacent clip rails due to differential movements between the ends.

SUMMARY OF THE UTILITY MODEL

According to one aspect of the present invention, a clip rail is provided. The clip rail includes an elongated body having a first end and a second end, the elongated body defining an upper recess configured to engage with one or more screen panels, the elongated body further defining a lower recess configured to engage a support member; wherein each of the first end and second end includes a two-platform structure, the two-platform structure configured to engage with another two-platform structure, wherein the first platform is offset from the second platform.

According to another aspect of the present invention, a clip rail having an interlocking structure is provided. The interlocking structure includes a first platform in a first plane; a second platform in a second plane, the second plane laterally offset from the first plane; a protrusion extending from the end of the elongated body; the end of the elongated body defining a hole, the hole and the protrusion having complementary shape and size.

According to another aspect of the present invention, a screening apparatus having a clip rail is provided. The screening apparatus includes a pair of opposed side walls having a lower edge portion, a plurality of support members secured to the lower edge portion of the opposed side walls, each of the support members configured to receive an intermediate member for supporting screening panels. The screening apparatus further includes a plurality of intermediate members, each of the plurality of intermediate members engaged with one of the support members, each of the plurality of intermediate members comprising one or more clip rails, wherein each of the clip rails includes an elongated body having a first end and a second end, the elongated body defining an upper recess configured to engage with one or more screen panels, the elongated body further defining a lower recess configured to engage a support member; wherein each of the first end and second end includes a two-platform structure, the two-platform structure configured to engage with another two-platform structure, wherein the first platform is offset from the second platform.

The side walls may take any suitable form such as a space frame or truss like construction. However, it is preferred that the side walls comprise a side wall arrangement whereby the side walls constrain material to the screening panel in use. The side wall profiles and stiffening are preferably modified until only the fundamental frequency modes remain. These frequency modes are modes are (1) with the side walls rotating out of phase, (2) with the side walls translating out of phase, (3) mode 1 lateral bending of the side walls and (4) mode 2 lateral bending of the side walls. The first three modes are low i. e. less than the operating frequency. The last is high i. e. greater than the operating frequency.

The side walls may be formed of plate steel. The side walls may be pre-drilled, punched or otherwise pierced for attachment of other components, or may be drilled at site of assembly. Preferably, the whole of the screening apparatus is essentially weld free.

The stiffeners may comprise a stiffening section secured to each side wall. The stiffeners may be welded to the side walls. However it is preferred that the stiffeners be bolted to the side walls, preferably by swaged bolts such as HUCK brand swaged bolts. These fixings comprise a bolt having a shank with locking grooves and a pintail extension, and a head. The shank is inserted through a prepared hole and a separate swageable collar is placed over the pintail. The nose assembly of an installation tool is placed over the pintail and pulls on the pintail, drawing the work pieces together. Continued pulling on the pintail moves an anvil forward swaging the collar into the locking grooves. The controlled swaging lengthens the collar to develop clamp. When the swaging is completed, the pintail separates from the shank, and the tool ejects the swaged collar out of the anvil, completing the installation. Hereinafter such bolts and bolts of equivalent function are referred to as "swaged bolts" The stiffeners may include a stiffener located in the region of each of the upper and lower edges of the side walls. These may be selected to be robust enough to control the vibrational modes. However, it is preferred to provide an intermediate stiffener therebetween. The intermediate stiffener may be located to equalize the modes of the high-mass, low frequency zone of the apparatus comprising the lower portion of the side walls and their associated screen support members and screen panels, relative to the upper side wall portions which are relatively of lower mass and thus higher frequency.

For the first and second modes, once equalized across the side walls of the relative mass effects, the configuration of each of the upper, lower and intermediate stiffeners may be optimized as to stiffening effect by selection of size, shape and material whereby the first and second vibrational modes may be at least 4 hz below and above the operating frequency respectively. Of course, for other forms of construction the person skilled in the art may formulate other engineering solutions to achieve the desired control of the first and second modes. The ultimate aim is to have the largest possible difference in frequency between the first and second modes, with the mean of the first and second mode frequencies as near as possible to the operating frequency.

Preferably, other modes of vibration are greater than 6 Hz higher or lower than the operating frequency.

The lower stiffener is preferably disposed close to the lower edge of the side wall and may be disposed either to the outside of the screen apparatus or to the screen panel side of the side wall. The lower stiffener preferably extends substantially to the respective ends of the side wall. The lower stiffener may be configured to be substantially equidistant from each of the mounting position of the screen panel support members along its length. As a consequence, it is preferred that the lower edge of the side walls also generally follows a line spaced from the mounting position of the screen panel support members.

The intermediate stiffener is preferably to the outside of the screen apparatus side wall to avoid collection of particulates thereon. The intermediate stiffener preferably extends substantially to the respective ends of the side wall.

The intermediate stiffener may extend substantially equidistant from each of the mounting positions of the screen panel support members along its length. The spacing of the intermediate stiffener from a line passing through the mounting positions of the screen panel support members, and the degree to which the intermediate stiffener is substantially equidistant from the line may be selected having regard to fine tuning of the aforementioned equalization of the modes of the lower high-mass, low frequency zone and the lower mass, higher frequency zone.

The upper stiffener may take any form consistent with the two functions of controlling the frequency of the first and second vibrational modes respectively, and allowing for the mounting of the torsion member secured between the side walls in the region of the exciter supports. The upper stiffeners may for example be substantially continuous along the upper portion of their respective side wall. Alternatively, the upper stiffeners may be discontinuous along the upper portion of their respective side wall, for example, where upper stiffener portions each extend from their respective end of the side wall to terminate adjacent the exciter support.

Preferably the upper stiffener is located substantially at the upper edge of the side wall. The exciters of screen machines are generally mounted at a desired position relative to the feed box and the screen deck. To this end, the side walls are generally configured to have an upper edge that extends from each end of the side wall to an apex region at the exciter beam. In the present utility model it is preferred that the side walls are generally configured to have an upper edge that extends from each end of the side wall to an apex region at the exciter support. The upper stiffeners may be located on the screen deck side of the side walls, or preferably on the outer surface of the side walls.

The respective stiffeners may be of any suitable section consistent with providing the desired stiffening function. At least one and preferably all of the stiffeners are of a generally Z-shaped section, and preferably having the terminal flanges substantially perpendicular to the web joining them. Z-sections have the advantage of ready access to the mounting flange for fixing tools such as swage bolt installing tools. In order to reduce stock requirements the stiffeners are preferably of the same Z-section.

The stiffeners may be secured to the side walls by any suitable means such as welding or bolting. In the case of the preferred Z-section stiffeners, at least one and preferably all of the stiffeners are secured to the side walls by swaged bolts. The Z-section stiffeners may be installed in either of the two possible orientations. However, it is preferred that the Z-sections be installed whereby the channel formed between the section and the side wall is an inverted channel, whereby the channels cannot accumulate fines or other material.

Both side walls may be provided with exciter mounts each located symmetrically over the upper edge of the respective side walls. The exciter mounts may be formed integrally with a mounting point for the torsion member or may be formed separately. For example, the exciter mount may be formed as an integral casting including the torsion member mount and swage-bolted to the side walls.

Unlike the prior art arrangements where the upper cross member both supported the exciter and braced the side walls, the present preferred exciter mount configuration allows the use of a torsion member in lieu of an exciter beam. The torsion member thus has no other functions than spacing apart the side walls and permitting the tuning of the torsion stiffness of the screen by selection of the torsion member stiffness. The torsion member preferably takes the form of a torque tube. The torque tube may be secured to the side walls, preferably through or integrally with the exciter mount casting as described above, by any suitable means. For example the torque tube may be welded to the casting, swage-bolted via a tube mount to the casting or, if secured directly to the side walls, by welding or via a tube mount welded or swage-bolted to the side walls.

There may be provided an end torsion member located at either or both ends of the assembly. A single end torsion member may be located at the feed box end of the apparatus since this gives more location options. The torsion member again may comprise a torque tube incorporated into the feed box which may be selected as to torsion stiffness to tune the vibrational modes of the apparatus. In a further embodiment of the utility model, the feed box torque tube is dispensed with, and the feed box itself includes a lower portion formed up from a single sheet. This relatively light construction is made possible by the vibrational control imposed by the above described configurations.

Selection of the torsion members and, in the case of the preferred tubular torque members, the selection of the tube diameters enables the lowering of the side wall torsion mode to greater than 2 Hz and preferably greater than 4 Hz below the operating frequency of typically 16 Hz. Thereafter the side wall stiffening may be varied to adjust mode 1 and 2 bending of the side walls to separate these modes by preferably more than 2 and about 4 hertz either side of the operating frequency. The selection of these parameters permits tuning of the screen apparatus to give an operating window of at least 4 and preferably 8 hertz. With traditional screens it is usually necessary to work with a window sometimes as small as 2 hertz. The large operating window of apparatus in accordance with the present utility model has removed the susceptibility of the structure to the natural frequency shifts caused by the variations in screen panel brand and age.

The torque tube between the exciter mounts also controls out-of-plane modes of the excite/side wall assemblies to eliminate in-phase and out-of-phase frequencies to get them out of the range of for example $_{>}$4 Hz of the operating frequency.

The screen panel support members may take any suitable form such as cross beams swage-bolted to the side panels as is used in the prior art.

However, the prior art deck support members are of heavier construction than is necessary to provide support for the screen panels in order to provide a significant contribution to resonance damage resistance. The deck support members are generally multiplely swage-bolted to the side walls and require removal from the inside of the machine. The deck support members in turn support stringers to which are mounted the screen panel support rails, all of which must be removed to service or replace the deck support members.

Traditional screen support cross-members are accordingly very hard to maintain requiring the side walks to be braced apart to remove and insert cross-members.

As a consequence, down time for replacement or repairs is extensive.

Accordingly, it is preferred to use a lighter construction of screen deck that is easier to maintain. In one embodiment of the present utility model, the need for an intermediate screen panel support structure of stringers and screen panel support rails is dispensed with and there is provided cross members that also serve as screen panel support members and are adapted to be secured to the side walls. The screen panel support members may be provided with a polyurethane over moulding adapted to enable the screen panels to clip directly thereto. The screen panel support members are preferably of tubular form. In particularly preferred embodiments of the present utility model, the tubular screen panel support members are secured to the side walls at apertures therethrough whereby the screen panel support members may be installed and removed through the side walls. Further, the apertures may be configured whereby the screen panel support members are removable from between the side walls by angling them out and down between the side walls without removing the means securing them to the side walls.

For example, the screen panel support members may be associated with mounting means that locate and selectively secure the screen panel support members when they are installed, the mounting means being adapted to cooperate with the aperture to selectively secure and enable removal of the screen panel support members by either or both of the foregoing methods.

The screen panel support members may be rigidly secured to the side walls. Alternatively, the screen panel support members may be resiliently mounted to the side walls in order to somewhat isolate the screen apparatus from the vibratory effects thereof.

In a further aspect this utility model relates to screening apparatus including a pair of opposed side walls, a plurality of screen panel support members disposed between and extending through respective apertures in at least one of said side walls of dimensions selected to allow passage of said panel support members therethrough from the outer surface of said at least one side wall, and mounting means secured to the outer faces of said at least one side wall about said apertures and adapted to locate said panel support members relative to said side walls.

The screen panel support members are preferably of tubular form.

Preferably, the tubular screen panel support members are selected to resist deflection under loads in use of 5 g. The screen panel support members may be adapted to receive standard modular screen panels, and as such are preferably disposed at 24 inch centers throughout. The screen panel support members may be adapted to mount the screen panels by any suitable means.

For example, the screen panel support members may be provided with apertures to receive securing arrangements such as bolts. Where bolts are used, these are preferably part of a shared securing arrangement such as that described in International Patent publication WO 00/53343.

However, it is preferred that the tubular integrity of the screen panel support members is not impinged by penetrating fixings. Accordingly, it is preferred that the screen panel support members be configured to allow snap-in fixing of the screen panel modules. In one embodiment, snap-in fixing is provided by moulding a flexible polymeric material such as polyurethane over the screen panel support member, the moulding having a profile formed therein, whereby corresponding portions moulded into the screen panels may engage therewith.

Clip in panels are known. However, different manufacturers tend to use different clip-in profiles. In one embodiment of the present utility model, the preferred tubular screen panel support members are provided with two or more clip in profiles, whereby selective radial orientation of the screen panel support member between the side walls enables the screening apparatus to be rapidly configured for different brands of panel.

Alternatively, the screen panel support members may be provided with a single clip-in profile that is configured to accept an intermediate clip-in element that is configured to accept one or another manufacturer's clip in panels. For example, the single clip-in profile may comprise a mushroom-like section or the like adapted to be inserted into a corresponding recess in a resilient intermediate clip-in element. The recess is preferably on the lower surface of the intermediate clip-in element, and the single clip-in profile is correspondingly located on a designated upper portion of the screen panel support members.

In particular, the intermediate clip-in element may be of the type configured to retain the respective edges of a pair of adjacent clip-in screen panels. The single clip-in profile may be formed symmetrically over the cross section of the screen panel support member, that is at the 12 o'clock position.

However, it is preferred to offset the single clip-in profile such that one of the lugs of the intermediate clip-in element bears on the uppermost portion of the curved surface of the screen panel support member (which approximates to flat) and the other bears on a formed land integrally moulded with the single clip-in profile and poly screen panel support member cover. This tends to reduce the amount of fines packing in the clearance between the lugs and the screen panel support member.

The end portion of each screen panel support member may be provided with a reference hole which may be used in cooperation with a fixed reference on the apparatus and particularly on the mounting collars for tubular screen panel support member to ensure that the single clip-in profile is correctly positioned on installation of the screen panel support member.

The intermediate clip-in element may be configured whereby installation of clip-in panels thereon renders the interconnection of the mushroom-like section or the like and the corresponding recess resistant to separation. For example, the intermediate clip-in element may be formed having a screen panel support member-engaging recess that is of lesser transverse dimension that an upper recess adapted to engage the edges of a pair of screen panels. This increases the section about the recess that has to distort to disengage the intermediate clip-in element from the screen panel support member. In the alternative or in addition, the cross section of material of the intermediate clip-in element may be generally greater at the recess for engagement with the single clip-in profile than at the recess adapted to engage the edges of a pair of screen panels. In the case where both means are used, the intermediate clip-in element may be formed having shoulders incidentally formed by the differing sections, wherein the screen panels are provided with corresponding abutting shoulders.

The locking of the screen panels to the intermediate clip-in element likewise tends to be increased in retaining strength by the engagement of the single clip-in profile with the corresponding recess. In order that the standard panels may be readily engaged and disengaged, the upper portion of the intermediate clip-in element may be relieved by transverse grooves cutting through the screen panel engagement lugs at selected intervals.

The panels may be adapted to accept accessories such as weir bars (otherwise known as cross dams) or the like. In one embodiment there is provided a weir bar comprising an elongate metal strip having polymeric material moulded over the upper portion thereof to form a weir having a portion of the metal strip exposed. The exposed portion of the metal strip is adapted to locate between adjacent screen panels in the assembly to interpose the weir bar across the flow of particulates over the screening surface. The adaptation may for example comprise an elongate ridge or recess, or one or more dimples, in the exposed strip and adapted to engage complementary shapes formed in the respective screen panel edges.

In one embodiment the panels are provided with moulded-in tapered lugs adapted to engage apertures in the exposed metal strip, wherein the taper diminishes toward the upper surface of the screen panel. This enables the weir bar to be driven in between the panels (with lubricant if necessary) until the strip passes over the tapered lug for the lug to snap into the apertures. The apertures are preferably elongated to provide for lateral tolerance when installing the weir bar.

The weir bars may be configured to extend across the width of the screen deck. However for ease of installation the weir bar is preferably of modular construction, wherein it is preferred that the weir bar module is as wide as a screen panel. If desired, the opposed side edges of the weir bar modules are configured whereby adjacent modules may interengage. For example, the respective side edges may be provided with a opposed step portions, which in use provide for a continuous weir bar assembly.

The metal strip may be multiply-perforated at the upper portion over which the polymer is moulded to form a positive key between the polymer and the strip. The metal strip is preferably stainless steel and the polymer is preferably polyurethane.

Traditional screens have large fabrications secured to their side to support spring mounts. These are notorious for producing fatigue cracks as they provide local stiffening to the side walls. Because the preferred tubular screen panel support members already extend through the side walls, it is possible to extend them further and mount the springs directly beneath via a cast screen panel support member to spring adapter. This not only simplifies the mounting of the screens but also reduced the potential for fatigue cracks.

In a yet further aspect, this invention relates to a method of mounting a screen panel support member to screening apparatus and including the steps of providing an aperture through at least one side wall of said screening apparatus, passing said support members therethrough from the outer surface of said at least one side wall, and securing said panel support member to said side wall with mounting means comprising a mounting flange adapted to be secured by fixings to of said at least one side wall about said aperture, and locating means for an end portion of said panel support member.

Again, the panel support member comprises a tubular section, and the locating means is accordingly adapted to receive the tubular end of the screen panel support member. There may be provided identical mounting means for both ends of the screen panel support members. Alternatively, the mounting may be provided by a fixed socket arrangement at one end and an arrangement in accordance with the disclosure at the other, whereby the screen panel support member is installed and/or replaced from one side of the apparatus. The mounting flange and locating means preferably comprises a unitary casting.

For example, there may be provided a mounting flange and substantially tubular extension into which the tubular screen panel support member end may spigot.

The tubular screen panel support member may be mounted in rubber bushes that would isolate the entire deck structure. For example, the mounting arrangement may provide a cone type locating arrangement of resilient material. By this means there may be provided a system that would isolate the screening panels from the main screen structure and remove or reduce their influence on the screens natural frequencies.

Alternatively, there may be provided a split clamp arrangement comprising one or more splits in the tubular extension, associated with clamping means adapted to close the tubular section about the screen panel support member end. In one embodiment of the present invention, the tubular extension is provided with an integrally formed lug which is bifurcated on cutting of the split and bored through to enable installation into the hole of a fixing adapted to tend to close the split. Thereafter on installation, the screen panel support member end may be clamped by installation of a swaged bolt or the like through the hole.

Preferably, the flange is provided with fixing holes whereby the flange may be swage-bolted to the side walls to support the screen panel support member. It is desirable from an engineering point of view to swage the bolts using a bolting pattern that is evenly distributed about the flange. However, it is also preferred that the clamping swaged bolt arrangement be as close to the flange as possible. Accordingly, it may be that the clamping swaged bolt arrangement may interfere with the installation of one or more flange mounting swaged bolts.

In this case it is preferred to dispense with the flange swaged bolt located at a position aligned with the clamp split whilst maintaining the remaining swaged bolt locations, rather than redistributing into a symmetric pattern.

Analysis of this joint revealed that the friction force between a split tube, swage bolt close clamp and a tube reduces exponential from a maximum at the swaged bolt closure to a minimum opposite the swaged bolt closure.

Accordingly the best orientation for the flange is with the swaged bolt closure at 90 degrees to the direction of excitation.

Where there are two splits, as a matter inherent to such clamping arrangements, a fourfold increase in friction can be achieved by using two half flanges clamped together with two swaged bolts, each at 90 degrees to the excitation direction. Accordingly, it is preferred that the plane passing through both splits is aligned. It may be seen that there are synergies in the mechanical compromises proposed in the preferred mounting system.

Australian patent specification AU-B-20043/95 describes a vibrational exciter for a screen machine comprising a pair of eccentric masses mounted for counter rotation on respective shafts, a pair of corresponding drive means disposed respectively to effect rotation of the eccentric masses and synchronization means adapted to establish a predetermined rotational velocity and phase relationship between the eccentric masses. The synchronization means allow effectively independent rotation thereof when the steady state of predetermined velocity and phase relationship is achieved. Since the gears do not transmit power in this steady state operation, there is a significant reduction in noise.

It has been determined that the direction of vibration should pass through the centre of gravity of the machine in use. However, as the screening apparatus wears, or panels are changed for a different brand, or the machine is loaded with material and progressively shifts this mass, the centre of gravity moves relative to the direction of vibration. This in turn results in a partial decoupling of the eccentric masses of the exciter.

In a further aspect this invention resides in screening apparatus having a pair of opposed side walls, an exciter mount provided over an upper edge of each side wall, and at least one exciter assembly mounted on each exciter mount, said exciter assembly including eccentric masses mounted for counter rotation on each end of respective driven shafts; and adjustment means adapted to dynamically align the effective direction of excitation with the centre of gravity of said screening apparatus in use.

The exciter assemblies may be of the general type illustrated in Australian patent specification AU-B-20043/95 and including pairs of eccentric masses mounted for counter rotation on respective shafts, a pair of corresponding drive means associated respectively with the shafts, and a gear train between the shafts forming synchronization means to establish a predetermined velocity and phase relationship between the rotating eccentric masses and to allow effectively independent rotation thereof when the predetermined velocity and phase relationship is achieved. The adjustment means may take any suitable form. For example, there may be provided phase variation means whereby the effective direction of excitation may be may be varied.

It is recognized that the direction of excitation is preferably provided whereby a line in that direction from the inertia divisor of the respective masses passes through the notional centre of gravity of the screen machine. The present applicant has determined that surprisingly as the centre of gravity of the machine shifts away from notional centre of gravity, the motion of the respective masses alters whereby the resolved components defining the direction of excitation shifts whereby the exciter naturally tries to track the centre of gravity.

As the screen panels wear the centre of gravity shifts slowly over time.

When the machine is loaded, or as the load moves across the panel, the centre of gravity shifts over shorter time frames. The present applicant has determined that as the centre of gravity shifts over the short and longer periods, the provision of what would in the art be regarded as an unacceptably large amount of lash between the respective gears of the apparatus described in Australian patent specification AU-B-20043/95 enables the apparatus to track variations in the centre of gravity.

From this observation, the present applicant has established that the phase variation may be provided by application of this inherent property of allowing excessive lash, or that in the alternative, the direction of excitation may be varied by mechanically varying the excitation direction by, for example, mounting the exciter on a mounting assembly adapted to provide for movement thereof to align the excitation substantially with the centre of gravity as it is located from time to time. For example, there may be provided inertial sensing means that senses the current centre of gravity and may direct the operation of the mounting assembly whereby the direction of excitation continuously tracks the centre of gravity.

In the interest of simplicity it is preferred that the exciter assembly utilize the inherent property of an exciter having a gear train synchronization means with up to 10° of lash be used. It has been determined by experiment that this amount of lash provides the boundary condition of sufficient synchronization at start-up whilst allowing the exciter direction to track the centre of gravity in use.

Preferably, the lash provided is about 4.0 to 4.5° each side of zero lash, especially for screen apparatus in accordance with the present utility model of about 6.5 tonnes dwt and adapted to operate at about 5 g.

In view of the unusual configuration of a gearbox having such a large amount of lash, there are particular features of the gear arrangement that are desirable. For example, it is desirable to increase the height of the tooth involute surface to increase duration of tooth engagement. The gears may be constructed having teeth substantially standard pattern of teeth according to this profile, with every second tooth removed. Preferably, the chordal length of each tooth is increased over the standard tooth chord by a degree selected to accommodate the expected shock loadings. Whilst the exact increase in chordal length is to be determined by testing, it is preferred that this dimension be maximised consistent with maintenance of the required lash.

BRIEF DESCRIPTION OF THE DRAWINGS

The invention is further described with reference to preferred embodiments of the invention as illustrated in the accompanying drawings, wherein.

DESCRIPTION OF THE PREFERRED EMBODIMENTS

Figure 1:
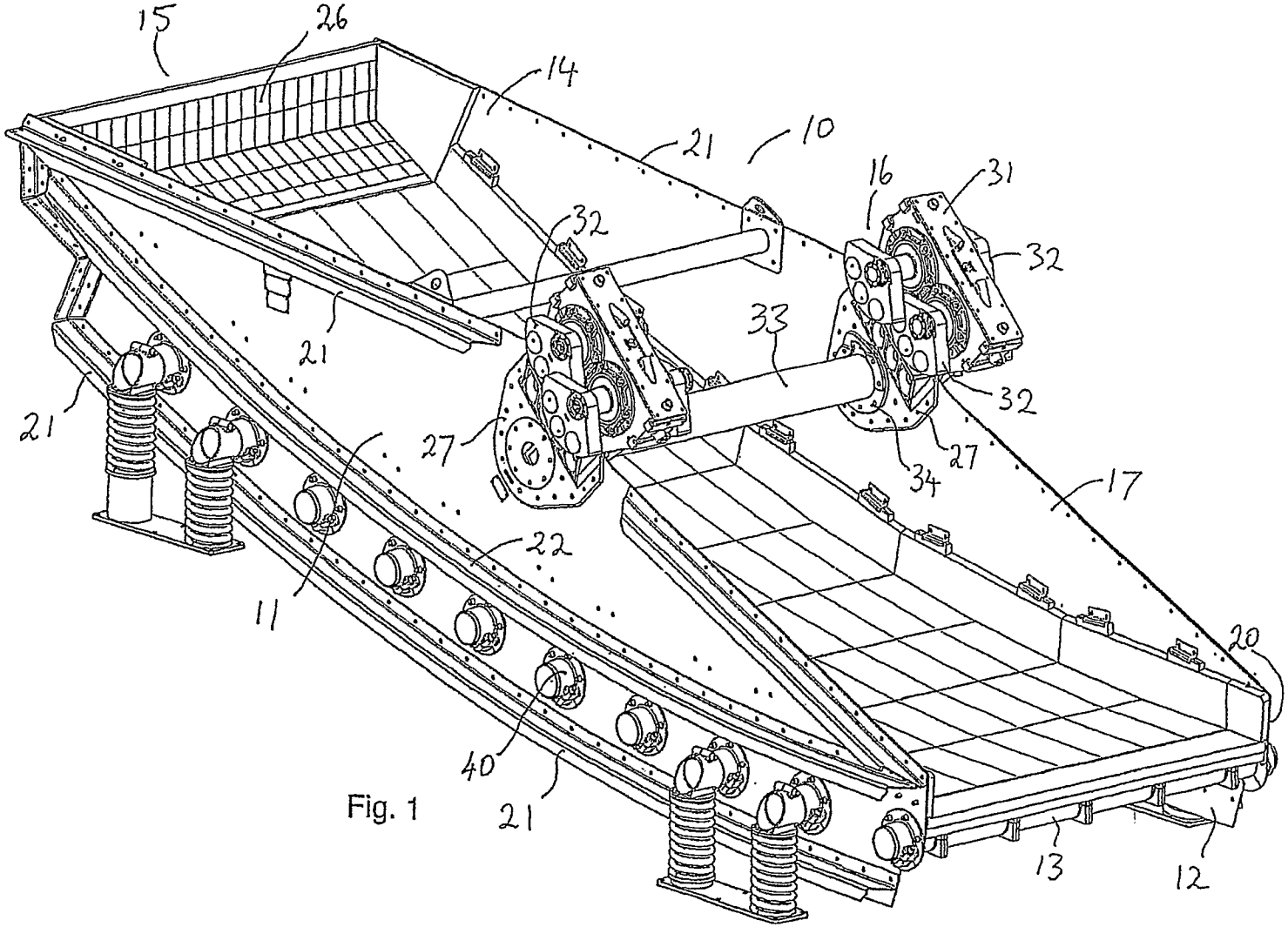
FIG. 1 is a top, front perspective view of apparatus in accordance with the present utility model.
Figure 2:
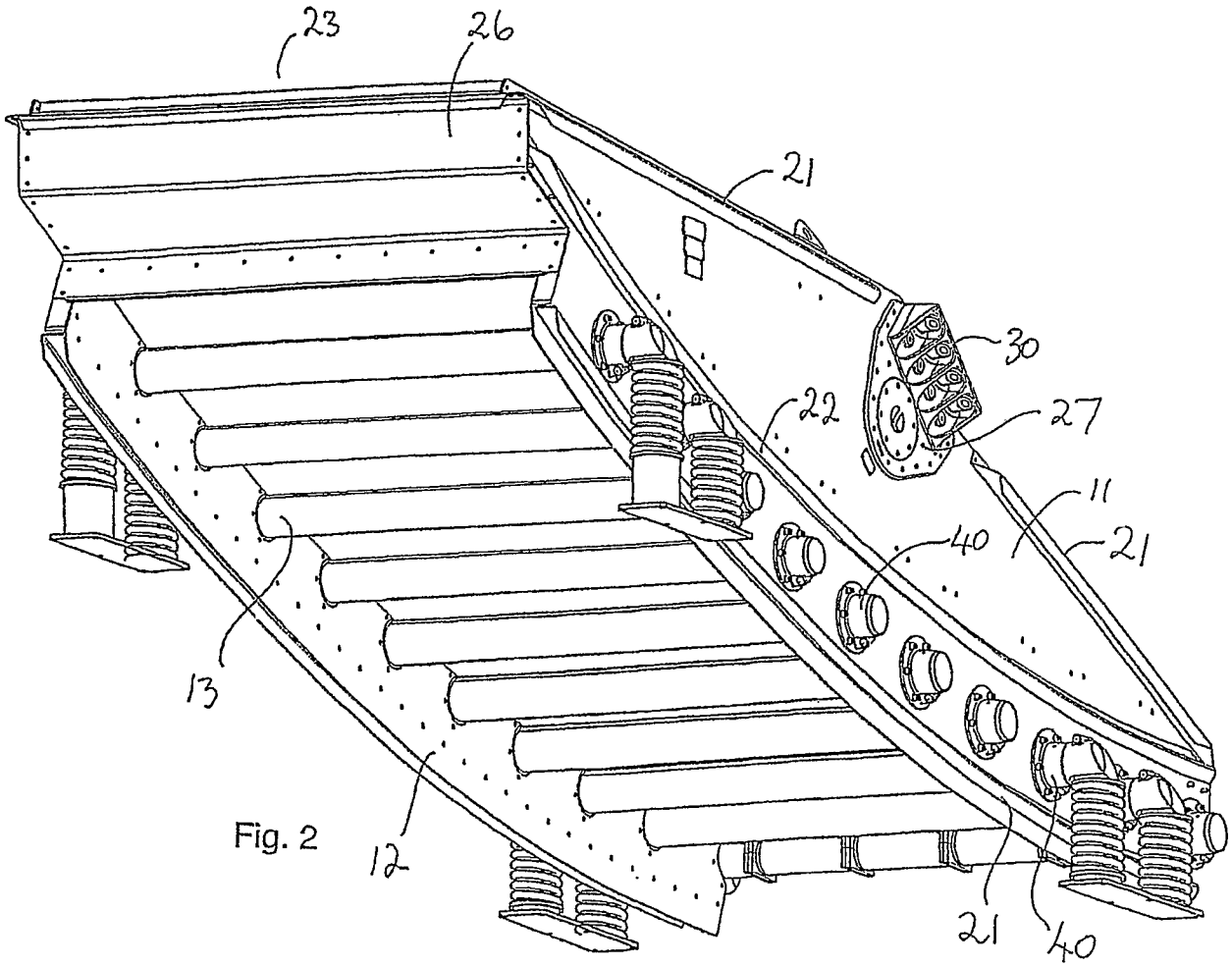
FIG. 2 is a bottom, rear perspective view of the apparatus of FIG. 1.
Figure 3:
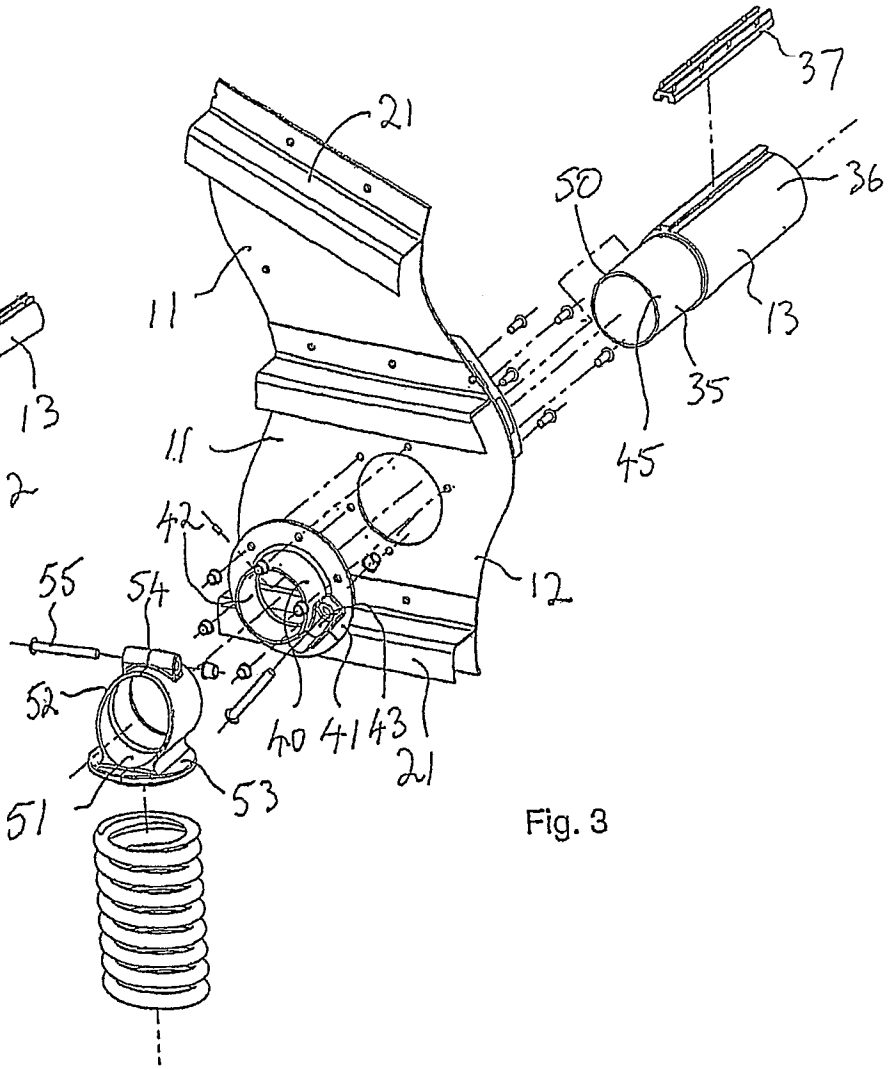
FIG. 3 is an exploded view of a screen deck assembly mounting method for the apparatus of FIG. 1.
Figure 4:
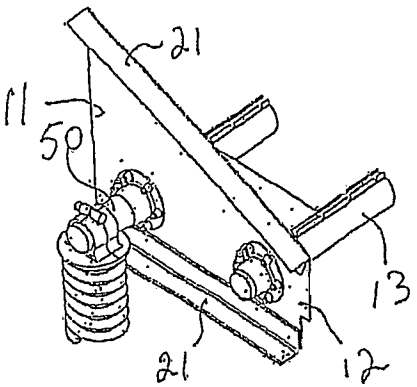
FIG. 4 is a detail view of a spring mounting arrangement of the apparatus of FIG. 1.

In the figures there is provided a screen apparatus 10 comprising steel side walls 11 having a lower edge portion 12 configured to accept screen support members 13 disposed in the shape of a conventional banana screen.

An upper edge portion 14 of the side walls 11 extends from the inlet end 15 of the side walls to an apex portion 16. A declining edge 17 extends from the apex portion 16 to the foot portion 20 of the side walls 11. The lower edge portion 12, upper edge portion 14 and declining edge portion 17 are each provided with edge stiffening 21 in the form of steel Z-section secured to the side walls 11. An intermediate Z-section stiffener 22 is secured to the side walls 11 and is disposed to follow the general curve of the banana screen panel support members 13.

The inlet end 15 of the side walls 11 are interconnected by an inlet box assembly 23 comprising an inlet box 26 which is swage-bolted to the side walls 11.

The apex portion is 16 configured with a recess adapted to receive an exciter mount casting 27 which is swage-bolted to the side walls 11. The exciter mount casting 27 comprises an exciter mounting platform 30 which is disposed substantially perpendicular to the plane containing the notional centre of gravity of the apparatus. By this means, an exciter assembly 31 may be bolted thereto such that the direction of excitation imposed by its counter rotating eccentric masses 32 is notionally aligned with the aforementioned plane containing the notional centre of gravity of the apparatus. The exciter mounting platform 30 is substantially symmetrical about the plane of the side wall 11 such that the net direction of excitation of the exciter assembly 31 is in the plane of the side wall 11.

A major torque tube 33 is secured between the respective exciter mount castings 27 by end fittings 34 swage-bolted to the castings 27. The major torque tube provides both the spacing for the side walls 11 at the apex portions 16 thereof, as well as providing the principle means that the torsion stiffness and vibratory modes of the apparatus are tuned.

The screen panel support members 13 each comprise a tubular steel body 35 having moulded thereover a polyurethane moulding 36 having integrally formed thereon a panel clipping profile 37. The side walls 11 are provided with opposed apertures of dimensions sufficient to pass the screen panel support members 13, whereby the screen panel support members 13 may be withdrawn through the side walls 11 from the outside of the screen apparatus. The screen panel support members 13 are spaced at 2-foot centers to match the length of existing polyurethane panels.

The screen panel support members 13 are mounted to the side walls 11 by the use of clamping collars 40. The clamping collars include a mounting flange 41 having a six-bolt pattern whereby the collar 40 may be swage-bolted to the side walls 11 on the outer surface thereof. Integrally cast with the mounting flange 41 is a generally tubular clamping sleeve 42 having formed therewith a securing pad 43, the securing pad 43 and clamping sleeve having a slot 44 cut therethrough. The securing pad 43 is cross drilled transverse the slot 44 whereby a swaged bolt may be installed therein to provide for clamping of the machined end 45 of the screen panel support member 13. The securing pad 43 occupies the space for the sixth bolt of the six-bolt pattern of swaged bolts securing the flange 41 to the side wall 11. The flange 41 is configured whereby the slot 44 and the sixth bolt space are substantially aligned at 90° to the direction of excitation of the apparatus.

Screen panels 46 have mounting profiles 47 adapted to clip in to the panel clipping profile 37 of the screen panel support members 13.

Selected ones of the screen panel support members 13 have machined ends 45 that extend to form mounting spigots 50 adapted to engage spring mounting clamps 51 each comprising a clamping collar 52 and base flange 53, the clamping collar 52 being provided with a securing pad 54 and being slotted whereby installation of a swaged bolt 55 through the securing pad 54 effects clamping of the spring mounting clamps 51 to the spigots 50.

Figure 5:
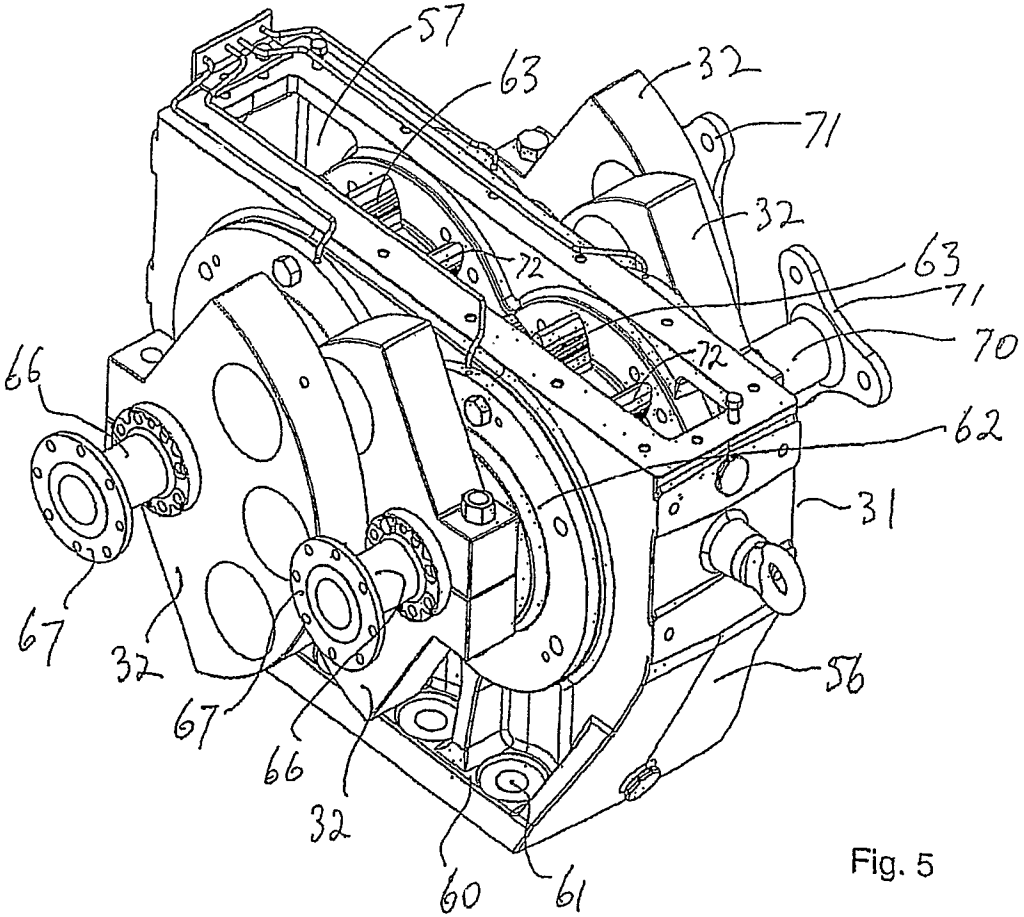
FIG. 5 is a perspective view of an exciter assembly for use with the apparatus of FIG. 1.
Figure 6:
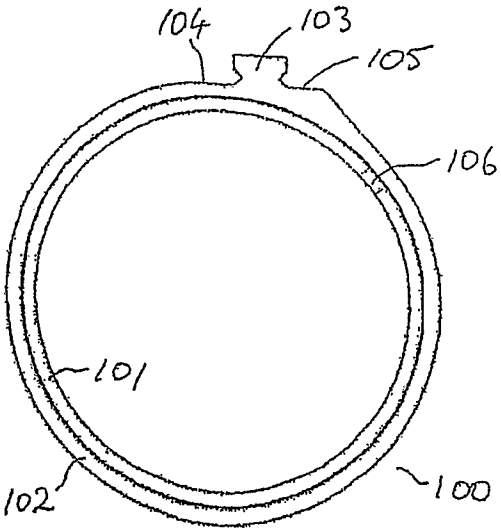
FIG. 6 is an end view of a screen panel support member suitable for use in the apparatus of FIG. 1.
Figure 7:
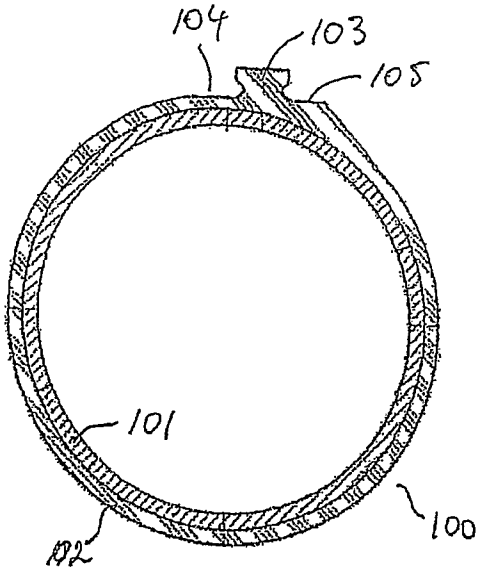
FIG. 7 is a section through the screen panel support member of FIG. 6.

The exciter assemblies 31 comprise a cast housing 56 best illustrated in FIG. 5, and closure (omitted for clarity) defining a sealed cavity 57. The cast housing 56 has an integral case mounting base 60 including holes 61 enabling the exciter assembly 31 to be secured to the exciter mounting platform 30. The cast housing 56 has secured thereto two pairs of opposed bearing and retainer assemblies 62. A pair of shafts (not shown) are mounted for rotation in their respective bearing and retainer assemblies 62 and extend out of both sides of the cast housing 56 through their respective bearing and retainer assemblies 62. A gear assembly 63 is keyed to each shaft to form a gear train coupling the shafts.

The outer ends of each of the shafts are provided with eccentric masses 32 secured to their respective shaft ends, aligned on their respective shafts and 180° out of phase between the shafts.

The outer faces of the outboard eccentric masses 32 mount drive spools 66 having drive flanges 67 adapted to be driven by electric motors (not shown).

The outer faces of the inboard eccentric masses 32 mount coupling spools 70 having flanges 71 adapted to accept flexible coupling for joining exciter units together. The gear assemblies 63 each 9 teeth 72 of an 18-tooth module at 325.0 mm pitch circle diameter 46 (PCD) and 65 mm axial dimension. This configuration gives a lash of 9°. Apparatus configured in accordance with the foregoing embodiment is advantageously operated at 16 Hz and is suited to operating a 6.5 tonne machine at 5 g with 7.5 kW per shaft electric motors.

With reference to the alternative details illustrated in FIGS. 6 to 12, there is provided an alternative screen panel support member 100 which may be, for example, a cross tube comprising a steel tubular body 101 within a moulded polyurethane outer cover 102. The moulded polyurethane outer cover 102 has integrally formed thereon a clip-in profile 103.

The clip-in profile 103 is offset from the vertical diameter of the tubular body 101 in use such that there is allowed a first land 104 over the vertical diameter of the tubular body 101. A second land 105 is integrally formed on the moulded polyurethane outer cover 102. The offset of the clip-in profile 103 is toward the foot of the banana screen apparatus. An index hole 106 allows accurate alignment of the screen panel support member 100 relative to the mounts 40.

The clip-in profile 103 is configured to accept an intermediate member 107 formed of resilient polymer material. The intermediate member 107 has a lower recess 110 adapted to engage the clip-in profile 103, and an upper clip-in profile 111 adapted to engage the edge profiles 112 of screen panels 113, whereby the screen panels are engaged in abutting relation on the intermediate member 107.

Figure 8:
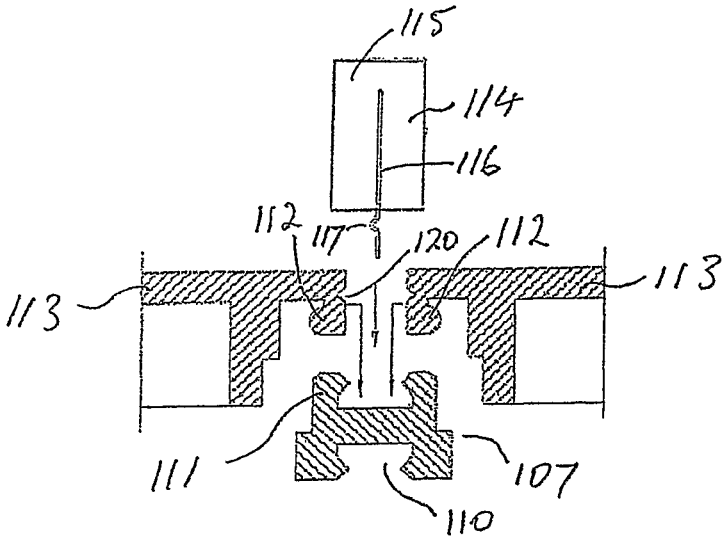
FIG. 8 is an exploded view in section of screen panels and their relation in use to a clip rail member and weir bar for mounting on the screen panel support member of FIG. 6.
Figure 9:
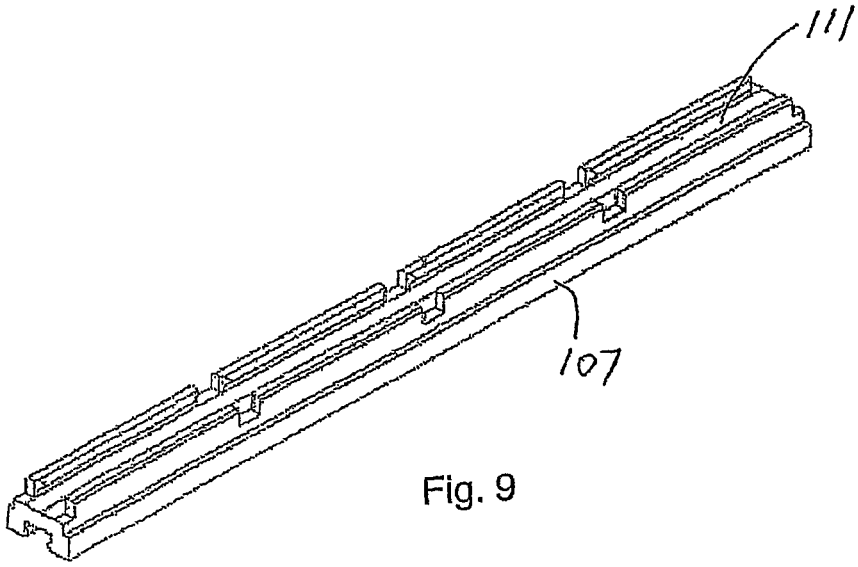
FIG. 9 is a perspective view of the intermediate clip-in member of FIG. 8.

In the embodiment of FIG. 8, there is provided a weir bar 114 comprising a polyurethane body 115 moulded over one edge of a stainless steel strip 116.

The stainless steel strip 116 is perforated at the overmoulded portion to provide a positive key for the polyurethane body 115. The stainless steel strip 116 has an elongate dimple 117 rolled therein spaced apart from and parallel to the polyurethane body 115. The screen panels 113 have a corresponding recess 120 moulded into the edges thereof and adapted to accept the elongate dimple 117 of the weir bar 114. The weir bar 114 is thus able to be retained in engagement with the screen panels 113.

Figure 10:
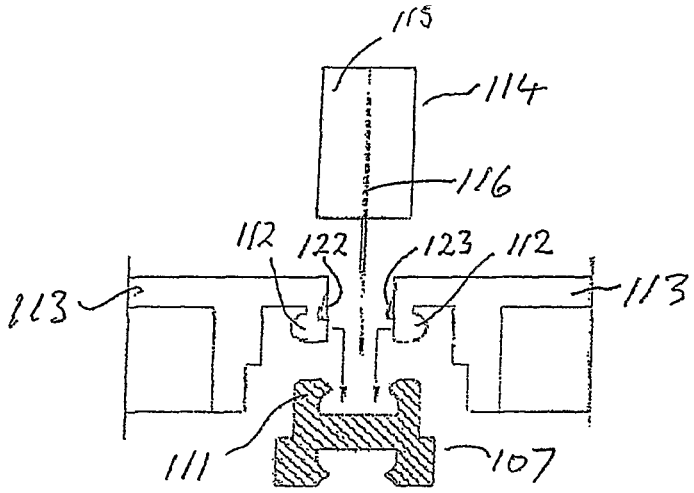
FIG. 10 is an exploded view in section of screen panels and their relation in use to an intermediate clip-in member and an alternate weir bar to that illustrated in FIG. 8, for mounting on the screen panel support member of FIG. 6.
Figure 11:
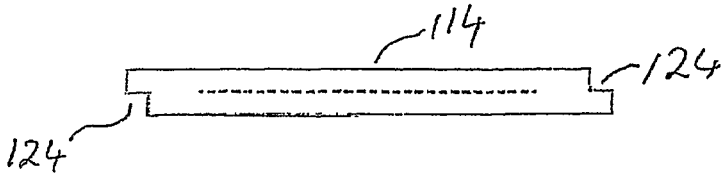
FIG. 11 is a plan view of the weir bar of FIG. 10.
Figure 12:
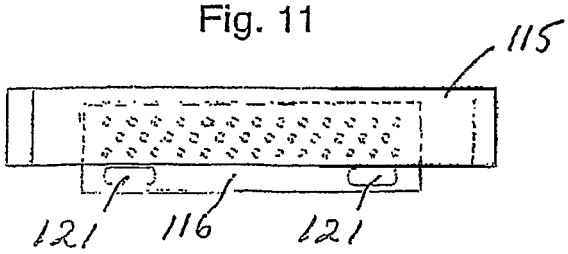
FIG. 12 is an elevation of the weir bar of FIG. 10.

In the embodiment of FIG. 10, there is provided a weir bar 114 substantially as generally constructed in FIG. 8. The stainless steel strip 116 has, in lieu of the elongate dimple 117, a pair of spaced apertures 121, spaced apart from and elongated in the direction parallel to the polyurethane body 115.

The screen panels 113 have respective complementary recesses 122 and lugs 123 moulded into the edges thereof and adapted to engage the elongate apertures 121 of the weir bar 114. The weir bar 114 is thus able to be retained in engagement with the screen panels 113, the elongation of the apertures 121 allows some tolerance in the installation. The sloping face of the lugs 123 permit the installation of the weir bar 114 after attachment of the screen panels 113, by driving the weir bar 114 between the panels 113 with use of a suitable lubricant. In order for the weir bars 114 to be deployed across the screen deck the ends of the weir bars are stepped at 124 to allow overlap.

Apparatus in accordance with this embodiment overcomes the significant maintenance disadvantage of the prior art. It is possible to simply cut off the securing swaged bolts, remove the flange and then remove the screen panel support members 13 through the apertures in the side walls 11. The screen panel support members 13 are each only effectively carrying the weight of one row of panels without having the added duty of reinforcing the screen apparatus 10. Accordingly the size and weight of the screen panel support members 13 can be significantly reduced relative to the weight of the screen panel support assemblies of prior art apparatus. The placement of the exciter assemblies 31 whereby excitation is in the plane of the side walls 11 and actively tracking the centre of gravity of the apparatus in use considerably assists in reducing undesirable modes of vibration in the apparatus. The ability to use minimum stiffening in the side walls 11 and the use of major torque tube selection to tune the torsion stiffness and vibratory modes enables an apparatus of considerably lighter weight and lower power consumption than prior art apparatus of similar capacity. The apparatus described above weighs about 6.5 tonnes and requires 7.5 kW to drive the apparatus in use at about 5 g.

According to one embodiment of the present utility model, the above-mentioned intermediate member may be one or more clip rails 200, described with reference to FIGS. 13-16.

Figure 13:
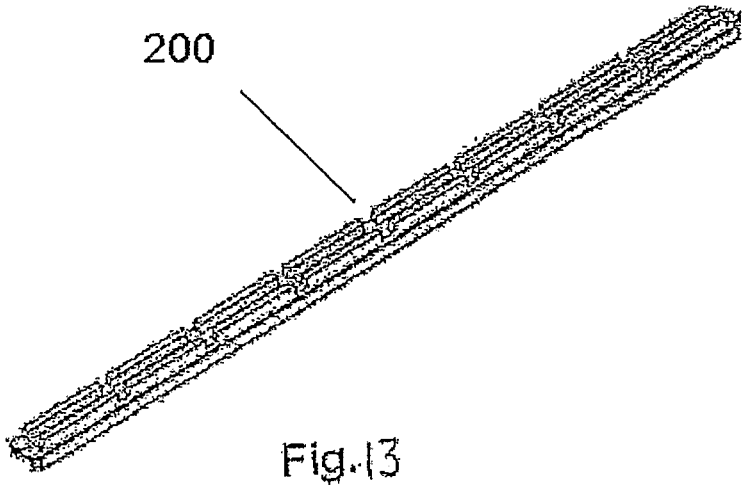
FIG. 13 is a top perspective view of a clip rail according to an embodiment of the present utility model.

FIG. 13 shows a perspective view of a clip rail 200 according to one embodiment of the present utility model. The clip rail 200 has a generally elongated body. A plurality of clip rails 200 may be joined end to end to form an intermediate member of any desired length.

Figure 14:
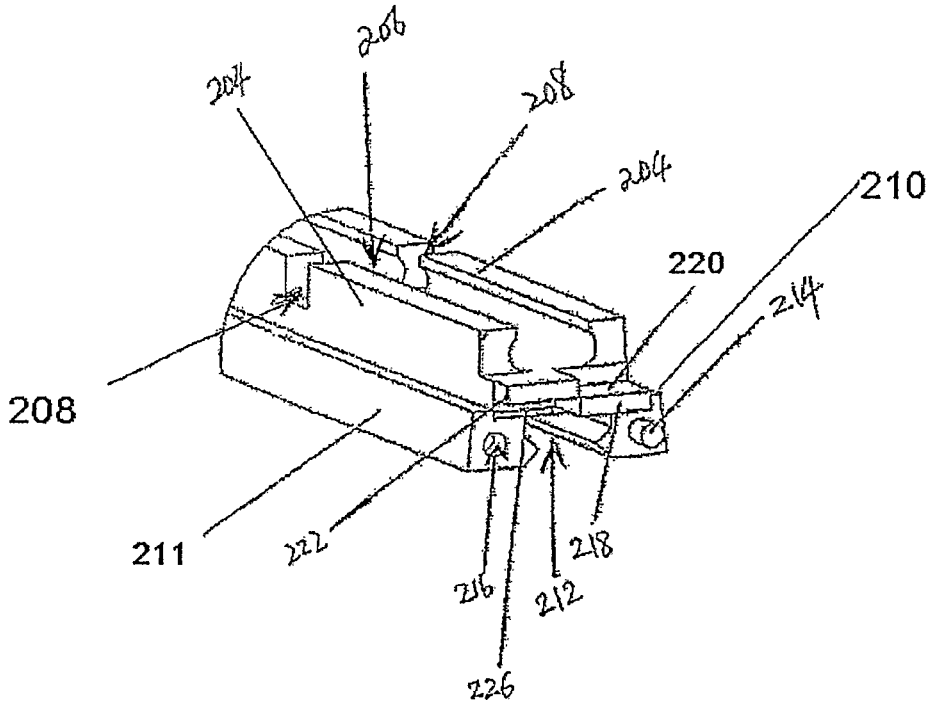
FIG. 14 is a top partial, enlarged perspective view of a clip rail end, according to an embodiment of the present utility model.
Figure 15:
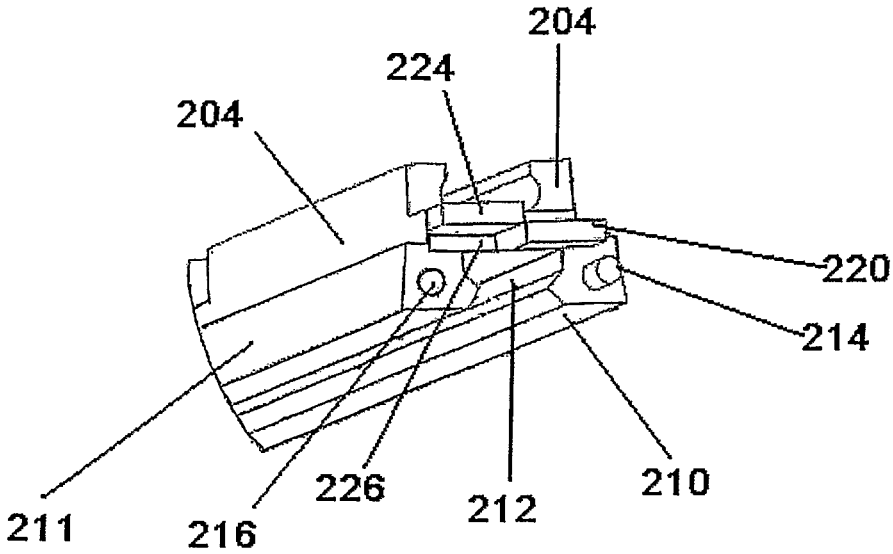
FIG. 15 is a bottom partial, enlarged perspective view of a clip rail end, according to an embodiment of the present utility model.

Referring to FIGS. 14 and 15, the clip rail 200 includes a pair of opposed upper sidewalls 204 that extend upwardly along the length of the clip rail 200. The opposed upper sidewalls 204 define an upper clip-in profile 206, forming an upper recess or groove along the clip rail 200, for engaging with the screen panels. A plurality of cutouts 208 are defined at intervals in the upper sidewalls 204. A pair of opposed lower sidewalls extend downwardly along the length of the clip rail 200, including a first lower sidewall 210 and a second lower sidewall 211, the opposed lower sidewalls defining a lower recess 212, or groove, along the lower side of the clip rail 200 for engaging with one of the plurality of support members 100 of the screening apparatus. Each end of clip rail 200 has a two-platform structure configured so that the end of one clip rail 200 aligns and engages with the end of a second clip rail.

The two-platform structure of the end of the clip rail includes a first platform 218 and a second platform 222 extending from the end of clip rail 200. In the illustrated embodiment, the first and second platforms 218, 222 are plank-shaped, having a flat, rectangular box shape. In the illustrated embodiment, the first platform 218 and the second platform 222 form a layered structure in that the first platform 218 lies in a first, lower plane and the second platform 222 lie in a second, upper plane. The first platform 218 and the second platform 222 are adjacent to each other, and they are vertically offset and laterally offset from each such that the first platform 218 is the lower-right platform and the second platform 222 is the upper-left platform. As illustrated in FIGS. 14 and 15, a lower-right edge of the second platform 222 abuts an upper-left edge of the first platform 218. In the illustrated embodiment, no surface of the first platform 218 overlaps with a surface of the second platform 222. In the illustrated embodiment, each of the first and second platforms 218, 222 has generally similar length, shape and size. A first space 220 is defined in the end of the clip rail 200 above the first platform 218. The space 220 is rectangular, box-shaped, and configured with a complementary size and shape to receive a second platform of another clip rail. A second space 226 is defined in the end of the clip rail 200 below the second platform 222. The space 226 is rectangular, box-shaped, and configured having a complementary size and shape to receive a first platform of another clip rail.

The first platform 218 and the second platform 222 are machined such that, when engaged with a first and second platform of an end of another clip rail, the platforms of the two clip rails fit closely together, reducing or eliminating any space between the platforms. Such close fitting of the platforms reduce or prevent lateral and vertical movement of the two clip rails relative to each other. Additionally, the configuration of the first and second platforms 218, 222 restrict or prevent the ingression of matter, such as minerals or other material that that is screened in the screening device, between two abutting clip rails. This undesirable ingression of matter in turn serves as a grinding substance between the clip rail and the support member, which causes wear and ultimate failure of the joint between the clip rail and the support member. By restricting or preventing the undesirable ingression of the matter between two abutting ends of adjacent clip rails and, additionally, between the clip rail and the support member, wear and failure of the joint between the clip rail and the support member is reduced or prevented.

Additionally, the end of the clip rail 200 includes a protrusion 214 extending from an end of the first lower sidewall 210 and a hole 216 defined in an end of the second lower sidewall 210. In one embodiment, the protrusion 214 has a cylinder shape and the hole 216 is defined in a shape complementary to the protrusion 214 such that it can receive the protrusion 214 of another clip rail. Alternatively, the protrusion can be in the form of other shapes and the opening can be defined or configured in a corresponding shape so that the opening of one clip rail can receive the protrusion of another clip rail when two clip rails engaged with each other end to end. In another embodiment, the clip rail can have two protrusions extending from one end thereof and two openings defined in the other end thereof, such that one clip rail aligns and engages with another clip rail. The protrusion 214 and the hole 216 serve to further align the end of one clip rail with the end of a second clip rail. Also, when the protrusion and hole of one clip rail are engaged with the hole and protrusion, respectively, of another clip rail, the engagement serves to further restrict vertical and lateral motion of the two clip rails relative to each other.

Figure 16:
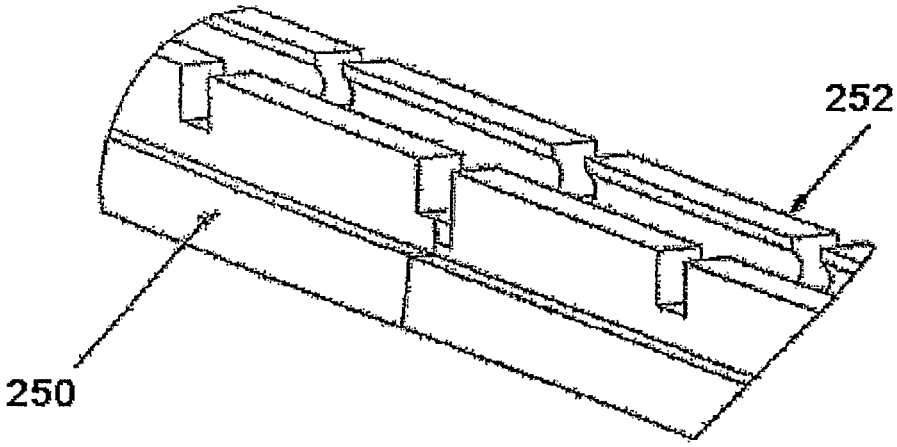
FIG. 16 is a partial, enlarged perspective view of the two assembled clip rails.

To engage an end of a first clip rail with an end of a second clip rail, the first clip rail is aligned with the second clip rail, and then two clip rails are moved longitudinally toward each other. The two-level structure of one end slidably engages the two-level structure of another end, engaging the first platform 218 and the second platform 222 of the first clip rail into the second space 224 and first space 220 of the second clip rail, respectively. The first platform 218 of the first clip rail is aligns with the second space 226 of the second clip rail, and second platform 222 of the first clip rail is positioned to align with the first space 220 defined in the end of the second clip rail. Also, the protrusion 214 of the first clip rail also slides into hole 216 of the second clip rail. The protrusion and platforms of the second clip rail similarly engage the hole and spaces of the first clip rail. As a result, the first clip rail 250 is engaged with the second clip rail 250, as shown in FIG. 16.

In one embodiment, each end of the clip rail includes defines an interlocking structure in that an end of one clip rail interlocks with an end of another clip rail. The interlocking structure includes the two-platform structure. The interlocking structure may also include one or more protrusions and holes.

Due to configuration of the two-platform end structure of the clip rail, according to the present utility model, possible wear and ultimate failure of the joint between the clip rails and the cross tubes can be avoided accordingly. In addition, another advantage of the present utility model is that the end structure is asexual, in that the end of one clip rail can engage with either end of another clip rail. Therefore, the direction of the clip rail is irrelevant to engagement, and a clip rail can be horizontally rotated 180 degrees and still be engaged with another abutting clip rail.

A number of variations are possible without departing from the scope of the utility model. For example, while the end of the clip rail 200 has a specific configuration and location of parts, different shapes and configurations may be used. For example, while the end includes two offset platforms, any number of platforms, planks, or protruding members of other shapes, may be used. The two or more platforms may also be offset in any desired configuration. Also, while the end includes one cylindrical protrusion and one complementary hole configured to receive a cylindrical protrusion, one or more protrusions and holes of other shapes may be used. While each end of the clip rail 200 has generally the same configuration, so that either end of a first clip rail may be connect to either end of a second clip rail, the end of the clip rail 200 may be configured such that two clip rails must be connected in a particular direction.

It will of course be realised that while the above has been given by way of illustrative example of this utility model, all such and other modifications and variations thereto as would be apparent to persons skilled in the art are deemed to fall within the broad scope and ambit of this utility model as defined in the claims appended hereto.

The invention claimed is:

1. A clip rail comprising:

an elongated body having a first end and a second end, the elongated body defining an upper recess configured to engage with one or more screen panels, the elongated body further defining a lower recess configured to engage a support member; wherein a two-platform structure extends longitudinally from each of the first end and the second end, the two-platform structure configured to slidingly engage with another two-platform structure in a longitudinal direction, wherein the first platform is offset from the second platform.

2. A clip rail as recited in claim 1, wherein the elongated body further defines first and second opposed, upper sidewalls extending upwardly along the length of the elongate body, and the first and second opposed, upper sidewalls defining the upper recess; and the elongated body further defines a first and second opposed, lower sidewalls extending downwardly along the length of the body, the opposed lower sidewalls defining the lower recess.

3. A clip rail as recited in claim 1, wherein the first platform is adjacent to the second platform, and the second platform is laterally and vertically offset from the first platform, and the first platform is in a first plane and the second platform is in a second plane.

4. A clip rail as recited in claim 1, wherein a protrusion extends from the first opposed lower sidewall at the first end, and a protrusion extends from the second opposed lower sidewall at the second end; and the second opposed lower sidewall at the first end defines a hole, and the first opposed lower sidewall at the second end defines a hole, the shape of the hole and the protrusions having complementary shape and size, the hole and protrusion of the first lower sidewall longitudinally aligned, and the hole and protrusion of the second lower sidewall longitudinally aligned.

5. A clip rail as recited in claim 1, wherein at the first end of the elongated body, a protrusion extends from the first opposed lower sidewall and the second opposed lower sidewall defines a hole, wherein the hole corresponds to the shape of the protrusion such that the opening is configured to receive a protrusion from a second clip rail.

6. A clip rail as recited in claim 4, wherein at the second end of the elongated body, a protrusion extends from the second opposed lower sidewall and the first opposed lower sidewall defines a hole, wherein the hole corresponds to the shape of the protrusion such that the hole is configured to receive a protrusion from a second clip rail.

7. A clip rail as recited in claim 1, wherein the elongated body, at the first end, defines a first space above the first platform and a second space below the second platform, wherein the first space is configured to receive the second platform of a second clip rail and the second space is configured to receive the first platform of the second clip rail.

8. A clip rail as recited in claim 1, wherein each of the first and second platform is generally plank-shaped.

9. A clip rail having an elongated body with a first end and a second end, each of the first end and the second end having an interlocking structure extending longitudinally therefrom, wherein the interlocking structure is configured to slidably engage with another interlocking structure in a longitudinal direction, the interlocking structure comprising:

a first platform in a first plane;

a second platform in a second plane, the second plane laterally offset from the first plane;

a protrusion extending from the end of the elongated body;

the end of the elongated body defining a hole, the hole and the protrusion having complementary shape and size.

10. A screening apparatus having a clip rail, the screening apparatus comprising:

a pair of opposed side walls having a lower edge portion;

a plurality of support members secured to the lower edge portion of the opposed side walls, each of the support members configured to receive an intermediate member for supporting screening panels; and a plurality of intermediate members, each of the plurality of intermediate members engaged with one of the support members, each of the plurality of intermediate members comprising one or more clip rails, wherein each of the clip rails includes an elongated body having a first end and a second end, the elongated body defining an upper recess configured to engage with one or more screen panels, the elongated body further defining a lower recess configured to engage a support member; wherein a two-platform structure extends longitudinally from each of the first end and the second end, the two-platform structure configured to slidingly engage with another two-platform structure in a longitudinal direction, wherein the first platform is offset from the second platform.

11. A screening apparatus as recited in claim 10, wherein the elongated body further defines first and second opposed, upper sidewalls extending upwardly along the length of the elongate body, and the first and second opposed, upper sidewalls defining the upper recess; and the elongated body further defines a first and second opposed, lower sidewalls extending downwardly along the length of the body, the opposed lower sidewalls defining the lower recess.

12. A screening apparatus as recited in claim 11, wherein the first platform is adjacent to the second platform, and the second platform is laterally and vertically offset from the first platform, and the first platform is in a first plane and the second platform is in a second plane.

13. A clip rail as recited in claim 10, wherein a protrusion extends from the first opposed lower sidewall at the first end, and a protrusion extends from the second opposed lower sidewall at the second end; and the second opposed lower sidewall at the first end defines a hole, and the first opposed lower sidewall at the second end defines a hole, the shape of the hole and the protrusions having complementary shape and size, the hole and protrusion of the first lower sidewall longitudinally aligned, and the hole and protrusion of the second lower sidewall longitudinally aligned.

14. A screening apparatus as recited in claim 10, wherein the elongated body, at the first end, defines a first space above the first platform and a second space below the second platform, wherein the first space is configured to receive the second platform of a second clip rail and the second space is configured to receive the first platform of the second clip rail.

15. A screening apparatus as recited in claim 10, wherein each of the first and second platform is generally plank-shaped.

* * * * *